US010480080B2

(12) United States Patent
Junge et al.

(10) Patent No.: US 10,480,080 B2
(45) Date of Patent: Nov. 19, 2019

(54) METHOD FOR ACTIVATING METAL SURFACES TO BE PHOSPHATED

(71) Applicants: ThyssenKrupp Steel Europe AG, Duisburg (DE); ThyssenKrupp AG, Essen (DE)

(72) Inventors: Fabian Junge, Düsseldorf (DE); Gregor Müller, Moers (DE); Nicole Weiher, Bochum (DE); Heinrich Meyring, Gladbeck (DE); Frank Panter, Dortmund (DE)

(73) Assignees: ThyssenKrupp Steel Europe AG, Duisburg (DE); ThyssenKrupp AG, Essen (DE)

( * ) Notice: Subject to any disclaimer, the term of this patent is extended or adjusted under 35 U.S.C. 154(b) by 374 days.

(21) Appl. No.: 15/302,365

(22) PCT Filed: Apr. 7, 2015

(86) PCT No.: PCT/EP2015/057464
§ 371 (c)(1),
(2) Date: Oct. 6, 2016

(87) PCT Pub. No.: WO2015/155163
PCT Pub. Date: Oct. 15, 2015

(65) Prior Publication Data

US 2017/0029954 A1 Feb. 2, 2017

(30) Foreign Application Priority Data

Apr. 11, 2014 (DE) ..... 10 2014 105 226

(51) Int. Cl.
*C23C 22/78* (2006.01)
*C23C 22/07* (2006.01)
(Continued)

(52) U.S. Cl.
CPC ..... *C23C 22/80* (2013.01); *C23C 18/30* (2013.01); *C23C 22/07* (2013.01); *C23C 22/78* (2013.01); *C23F 17/00* (2013.01); *C25D 3/22* (2013.01)

(58) Field of Classification Search
CPC ..... C23C 22/78–80
(Continued)

(56) References Cited

U.S. PATENT DOCUMENTS 5,160,551 A 11/1992 Rein
6,361,623 B1 3/2002 Ishikura
(Continued)

FOREIGN PATENT DOCUMENTS

AU 198933782 A 11/1989
CN 1197849 A 11/1998
(Continued)

OTHER PUBLICATIONS

Int'l Search Report for PCT/EP2015/057464 dated Sep. 22, 2015 (dated Oct. 13, 2015).
(Continued)

*Primary Examiner* — Lois L Zheng
(74) *Attorney, Agent, or Firm* — Lathrop Gage L.L.P.

(57) ABSTRACT

A method of activating a metal surface, such as a galvanized steel sheet, before a phosphating process, may involve bringing the metal surface into contact with an activating bath containing activating particles, which may be based on phosphate and/or titanium, dispersed in water. To alleviate or even eliminate the problems of poor adhesion of surface coatings to preferably electrolytically galvanized, phosphated metal strip, an additive that suppresses or at least slows agglomeration of the activating particles may be added to the activating bath. In some examples, polyethylene glycol (PEG) and/or sodium stearate may be added.
(Continued)

Further, the particle size distribution of the activating particles present in the activating bath may be determined and the activating bath may be replaced or taken out of operation as a function of the particle size distribution of the activating particles.

17 Claims, 1 Drawing Sheet

(51) Int. Cl.

| | |
|---|---|
| ***C23C 22/80*** | (2006.01) |
| ***C23C 18/30*** | (2006.01) |
| ***C23F 17/00*** | (2006.01) |
| ***C25D 3/22*** | (2006.01) |

(58) Field of Classification Search
USPC ..... 148/254
See application file for complete search history.

(56) References Cited

U.S. PATENT DOCUMENTS

| | | | | |
|---|---|---|---|---|
| 2007/0240604 | A1 | 10/2007 | Inbe | |
| 2008/0041498 | A1* | 2/2008 | Inbe | C23C 22/80 148/254 |

FOREIGN PATENT DOCUMENTS

| | | | |
|---|---|---|---|
| CN | 1470672 | A | 1/2004 |
| CN | 101243206 | A | 8/2008 |
| CN | 101379217 | A | 3/2009 |
| CN | 201670879 | U | 12/2010 |
| CN | 102308024 | A | 1/2012 |
| DE | 102008054407 | A1 | 6/2010 |
| EP | 0454211 | A1 | 10/1991 |
| EP | 00977908 | b | 2/2000 |
| EP | 1378586 | B | 1/2004 |
| GB | 2174719 | A | 11/1986 |
| JP | 2001089869 | A | 4/2001 |
| WO | 2007020985 | A1 | 8/2005 |
| WO | 2007089015 | A1 | 2/2007 |
| WO | 2012086494 | A1 | 12/2011 |

OTHER PUBLICATIONS

Per-Erik Tegehall: "The mechanism of chemical activation with titanium phosphate colloids in the formation of zinc phosphate conversion coatings"; Colloids and Surfaces; vol. 49; Jan. 1, 1990 (Jan. 1, 1990); pp. 373-383.

M Wolpers et al: "Activation of galvanized steel surfaces before zinc phosphating—XPS and GDOES investigations"; Applied Surface Science; vol. 179; No. 1-4; Jul. 1, 2001 (Jul. 1, 2001); pp. 281-291.

Per-Erik Tegehall: "Colloidal titanium phosphate. the chemical activator in surface conditioning before zinc phosphating"; Colloids and Surfaces; vol. 42; No. 1; Jan. 1, 1989 (Jan. 1, 1989); pp. 155-164.

* cited by examiner

METHOD FOR ACTIVATING METAL SURFACES TO BE PHOSPHATED

CROSS REFERENCE TO RELATED APPLICATIONS

This application is a U.S. National Stage Entry of International Patent Application Serial Number PCT/EP2015/057464, filed Apr. 7, 2015, which claims priority to German Patent Application No. DE 10 2014 105 226.9 filed Apr. 11, 2014, the entire contents of both of which are incorporated herein by reference.

FIELD

The present disclosure relates to methods of activating metallic surfaces for phosphating processes to alleviate or eliminate the problems associated with poor adhesion of surface coatings.

BACKGROUND

Zinc phosphate layers are used in the prior art for surface treatment of galvanized fine steel sheet in order to improve surface-relevant properties of the galvanized fine steel sheet. These include, in particular, increasing the corrosion resistance and improving the formability and adhesion of surface coatings.

It has been found by the applicant that, in past years, not periodic, always recurring surface coating adhesion problems occurred on, for example, electrolytically galvanized and phosphated metal strip, in particular steel strip (fine sheet).

DETAILED DESCRIPTION

Figure 1:
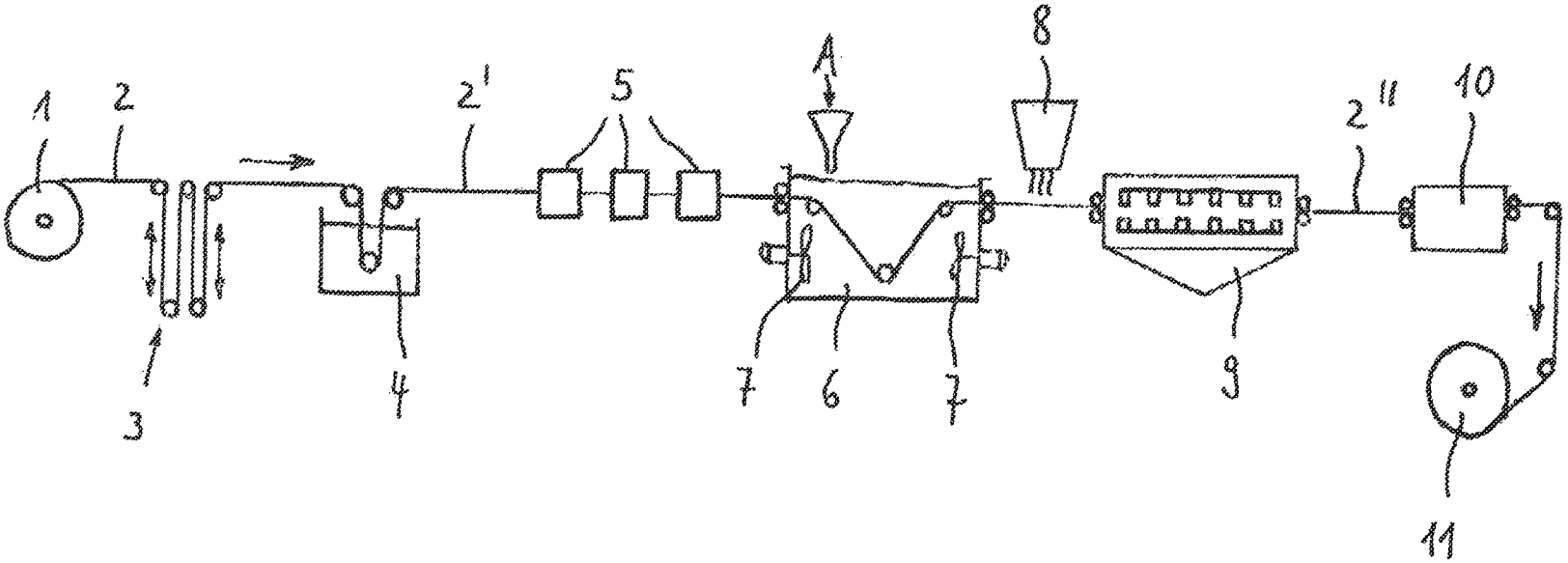
FIG. 1 is a schematic flow diagram of an example method for continuous electrolytic galvanizing and phosphating of steel strip.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element.

The present disclosure relates to methods of activating metal surfaces, in some examples, of coated steel sheet, such as galvanized steel sheet, for instance, before a phosphating process, in which the metal surface is brought into contact with an activating bath containing inorganic-metallic activating particles, based on phosphate and/or titanium, for example, dispersed in water.

Thus, one example object of the present disclosure is to provide a method by which the problems of poor adhesion of surface coatings to metal strip can be considerably reduced or even avoided. With respect to methods such as that identified above, this example object is characterized by at least one additive that suppresses or at least slows agglomeration of the activating particles being added to the activating bath.

The inventors have examined the mechanisms of activation, nucleation and growth of the zinc phosphate crystals on the zinc coating. They have established that agglomerates of activating particles are formed with increasing time of operation of the activating bath. In addition, they were able to recognize an adverse effect of the increasing particle sizes in the activating bath on phosphating and adhesion of surface coatings.

The addition according to the invention of an additive which suppresses or at least significantly slows agglomeration of the activating particles enables the problems of poor adhesion of surface coatings to phosphated metal strip, in particular galvanized, phosphated steel strip, to be considerably reduced or even avoided.

The additive used for stabilizing the activating bath can be, in particular, one or more of the following materials:

- Nonionic, anionic, cationic and/or zwitterionic surfactants
- Polyethylene glycol (PEG), in particular from 1 to 200 g/l of PEG
- Salts, in particular alkali metal and alkaline earth metal salts of fatty acids, e.g. sodium stearate, but also salts of branched and unbranched, saturated and unsaturated carboxylic acids with other cations which do not have an adverse effect in the activating bath and in the subsequent process steps at customary fatty acid salt concentrations (e.g. Zn)
- Carboxylic acids, in particular formic acid, acetic acid, citric acid, tartaric acid, ascorbic acid, nitrilotriacetic acid (NTA), iminodisuccinic acid and salts thereof, in particular sodium and potassium salts
- Poly(oxy-1,2-ethanediyl)carboxylic esters, in particular sorbityl poly(oxy-1,2-ethanediyl)monododecanoate, polyoxyethylene(20)sorbitan monooleate and further polysorbates
- Alkyl ethers of polyethylene glycol, in particular isotridecyl polyethylene glycol ether
- Sulfates and sulfonates in general, in particular alkylbenzenesulfonates
- Phosphoric and phosphonic acids and esters and salts thereof, in particular phosphonates such as 1-hydroxyethane(1,1-diphosphonic acid), phosphonobutanetricarboxylic acids, aminophosphonates such as aminotrimethylenephosphonic acid, diethylenetriaminepenta (methylenephosphonic acid) and ethylenediaminetetra (methylenephosphonic acid), N-(phosphonomethyl) glycine and salts thereof
- Monomeric and polymeric esters and ethers, in particular 2-phenoxy-1-ethanol, alkyl alcohol ethoxylates, in particular with alkyl=linear C9-C11 hydrocarbons
- Polycarboxylates, in particular polymers and copolymers of acrylic acid, of maleic acid and of fumaric acid and also alkali metal, alkaline earth metal and transition metal salts thereof, in particular zinc salts
- Alkylphenol ethoxylates, in particular nonylphenol ethoxylates
- Amino acids and in particular polyamino acids and salts thereof, in particular polyaspartic acid and salts thereof, in particular sodium and potassium salts
- Azoles, in particular benzotriazoles and tolyltriazoles, benzimidazoles An advantageous embodiment of the method of the invention is characterized in that polyethylene glycol (PEG) and/or sodium stearate is added to the activating bath as additive for suppressing or slowing agglomeration of the activating particles. These two materials have each been found to be very effective in experiments.

To slow the agglomeration of the activating particles in the activating bath, it is also advantageous for, according to a further preferred embodiment of the method of the invention, the activating bath to be agitated continuously or discontinuously by stirring and/or pump circulation and/or introduction of ultrasound. In this way, the operating life of the activating bath can be increased further. The intensity of bath agitation (by stirring and/or pump circulation and/or introduction of ultrasound) should, however, not be too high since otherwise agglomeration of the activating particles in the activating bath may be promoted. The activating bath is preferably stirred by means of at least one mechanical stirrer.

A further preferred embodiment of the method of the invention is characterized in that the particle size distribution of the activating particles present in the activating bath is determined and in that the activating bath is replaced or taken out of operation as a function of the particle size distribution of the activating particles. In this way, critical or excessive deposition (adhesion) of agglomerated activating particles on the preferably electrolytically galvanized metal sheet can be very largely avoided and defect-free adhesion of surface coatings can thus be achieved.

In this context, it is advantageous for, according to a preferred embodiment of the method of the invention, the particle size distribution of the activating particles to be determined at regular intervals or continuously by means of dynamic light scattering (photon correlation spectrometry) during operation of the activating bath. As an alternative or in addition, the particle size distribution of the activating particles can be determined at regular intervals or continuously by means of nanoparticle tracking analysis (NTA) during operation of the activating bath. These two measurement methods are each particularly useful and reliable at the particle sizes and distribution widths relevant here. The measurement can be carried out in each case on separate, limited samples of the activating bath or alternatively by means of at least one flow-through measurement cell.

However, other measurement methods can also be employed for determining the particle sizes and particle size distribution of the activating particles in the method of the invention. For measurement in liquid, for example on separate, limited samples and also in a flow-through measurement cell, the following measurement methods are, for example, also conceivable here:

- Static laser light scattering
- Coupling of optical microscopy with automatic image analysis
- Resonant mass measurement
- Acoustophoretic measurement technology
- Ultrasound spectrometry
- Field flow fractionation
- Hydrodynamic chromatography
- Capillary hydrodynamic fractionation
- Spatial filter velocimetry
- Atomic force microscopy on particles on planar substrate surfaces in air, vacuum or liquid.

As an alternative or in addition, measurements can, in this context, be carried out on suitable supports or substrates using electron-microscopic methods, for example:

- Scanning electron microscopy (SEM); in particular automatedly counting preferably individualized particles applied to planar substrates such as metallo-graphically polished surfaces and classifying these according to geometric parameters, preferably using image analysis, in order to obtain a statistically qualified size distribution. SEM images in topographic contrast and/or mass contrast are suitable.
- (Scanning) transmission electron microscopy (TEM, STEM): in particular particles applied to supports through which radiation can pass, e.g. a polymer film (surface coating film) or particles embedded in a matrix through which radiation can pass (e.g. polymers) or particles which are to be imaged by means of irradiation from the side and are adhering to supports (e.g. strands of a commercial TEM mesh).
- EDX or WDX distribution images in respect of the, or some of the, chemical elements which have been recorded by means of REM or STEM and substantially describe the composition of the particles.

With regard to effective activation, nucleation and good growth of the zinc phosphate crystals on the zinc coating, it is additionally advantageous for the activating bath to be adjusted, according to a further preferred embodiment, in such a way that it has an activating particle concentration in the range from 0.1 g/l to 10 g/l, in particular from 0.5 g/l to 3 g/l.

The invention will be illustrated below with the aid of a drawing and a number of working examples. The single FIGURE schematically shows a process flow diagram of continuous electrolytic galvanizing and phosphating of (rolled) steel strip.

A cold-rolled and optionally dressed steel strip (fine steel sheet) is provided as coil 1. The steel strip (fine steel sheet) 2 is unrolled from the coil 1 and welded onto the end of the previous strip. Since the subsequent electrolytic surface upgrading is a continuous process, the fresh strip entering the electrolytic upgrading plant is firstly passed into a strip loop storage 3 where it is stored in one or more loops so that the coating process does not have to be stopped when the beginning of a steel strip is welded onto the end of the previous steel strip.

In a first stage of the upgrading process (coating process), the strip surface is usually firstly mechanically and chemically cleaned. The strip surface is subsequently roughened in an acidic pickle before the strip 2 is passed through the electrolytic coating cells 4 and galvanized there. There, the steel strip 2 is dipped into a sulfuric acid zinc electrolyte and at the same time connected as cathode. In the case of soluble zinc electrodes, these are likewise dipped into the electrolyte solution and connected as anode. The zinc cations migrate from the anode through the electrolyte to the steel strip surface and are deposited cathodically there. In the case of insoluble anodes, on the other hand, the zinc is already present in solution in the electrolyte, and the anodes consist of appropriately more noble materials. The amount of zinc deposited on the strip surface depends in each case on the current density and the coating time. In order to achieve a zinc layer thickness of a few microns at a strip speed of, for example, 100 m/min, the steel strip 2 has to run through a plurality of coating cells 4 connected in series because of the relatively short coating time and accordingly low deposited amount in one electrolytic cell 4 at such a strip speed. In order to remove the electrolyte from the strip surface subsequently and thus avoid introduction of electrolyte into the next process step, the electrolytically galvanized steel strip 2' is passed through a multistage rinsing apparatus 5.

A generally slightly alkaline activating bath 6 follows as pretreatment step for phosphating. Activating baths serve, in a phosphating process, to increase the number of nuclei and thus the phosphate crystals per unit area and thus increase the rate of crystal formation and increase the degree of coverage.

The activating bath 6 contains activating particles, generally particles based on phosphate and/or titanium or on metal oxides, dispersed in water. The activating particles which are, for example, obtainable in powder form are dispersed in water and form a colloidal solution with this. The activating bath 6 is, for example, adjusted so that it has an activating particle concentration in the range from 0.1 g/l to 10 g/l, in particular from 5 g/l to 3 g/l, preferably from 0.7 g/l to 1.5 g/l.

Suitable activating agents (activating particles) for the phosphating of electrolytically galvanized fine steel sheet 2' are, for example, obtainable under the trade names SurTec® 145, SurTec® 610 V, SurTec® 615 V, SurTec® 616 V, Fixodine®X, Fixodine®50, Fixodine®50CF (now Bonderite® M-AC 50CF), Fixodine®950 (now Bonderite® M-AC 950), Fixodine®G 3039, Fixodine®C 5020 A, Fixodine®G 5020 B, Fixodine®C 9114, Fixodine®9112, Gardolene® Z26, Gardolene® V 6599, Gardolene® V 6560 A, Gardolene® V 6559, Gardolene® V 6526, Gardolene® V 6522, Gardolene® V 6520, Gardolene® V 6518, Gardolene® V 6513, Prepalene® X and Chemkleen® 163. Activating particles (activating agents) used for the pretreatment of metal surfaces to be phosphated, for example the fine steel sheet 2', are usually Jernstedt salts or titanyl phosphates.

To maintain the dispersed state of the activating particles, the activating bath 6 is continuously or discontinuously stirred and/or circulated by pumping and/or treated with ultrasound. For example, the activating bath 6 is stirred by means of at least one mechanical stirrer 7.

After passing through the activating bath 6, the liquid film is squeezed or wiped off from the steel strip 2' in order to avoid introduction of the possibly alkaline medium (liquid film) into the acidic phosphating solution. Drying of the steel strip surface can also be advantageous at this point. Accordingly, a hot air blower 8 is shown in the FIGURE. In the phosphating stage 9, the phosphating solution is sprayed onto the activated strip surface.

This leads firstly to pickling of the zinc surface and secondly to growth of the zinc phosphate crystals on the activated regions. The remaining supernatant phosphating solution is subsequently squeezed off from the strip and the phosphated strip 2" is then dried by means of a strip drier 10. In the last steps of this strip upgrading process, the phosphated steel strip 2" is optionally oiled and rolled up to give a coil 11, so that it can be transported in readily handlable form to the customer.

At the customer's premises, for example an automobile manufacturer, plates are stamped from the phosphated steel strip and pressed to form components, for example bodywork parts. Since the forming of the plates by drawing and/or stretching of the material and also abrasion can result in damage to the phosphate layer, the metal surface is again activated and after-phosphated. The forming step is therefore usually followed by a degreasing step in a slightly alkaline solution and also rinsing-off of the cleaner in a multistage rinsing apparatus. Rinsing is followed by the renewed activation step and the after-phosphating.

The phosphating solution is removed by a further multistage rinsing apparatus before a surface coating is applied to the component. Here, a primer is usually applied to the phosphated component surface by means of cathodic dip coating. The components with the still moist primer surface are conveyed into an oven, typically a flow-through oven, where the surface coating composition is crosslinked and cured at relatively high temperatures (e.g. about 180° C.). A filling coating and finally a topcoat is then optionally applied.

To avoid poor adhesion of the surface coating caused by activating particle agglomerates and to achieve good adhesion of the surface coating, at least one additive A which suppresses or at least slows agglomeration of the activating particles is, according to the invention, added to the activating bath 6 which precedes phosphating. The additive forms an envelope around the activating particles, by means of which agglomeration of the activating particles can be suppressed at least for some time compared to conventional activating baths. For this purpose, polyethylene glycol (PEG), for example, preferably PEG having molar masses below 6000 g/mol, in particular about 400 g/mol (known as PEG 400), is added as additive A to the activating bath 6. For example, from 1 to 200 g/l of PEG are added to the activating bath, with the activating bath 6 having an activating particle concentration in the range from 0.1 g/l to 10 g/l, in particular from 0.5 g/l to 3 g/l, preferably from 0.7 g/l to 1.5 g/l.

Instead of polyethylene glycol (preferably PEG 400), sodium stearate is, in a further working example of the method of the invention, added as additive A to the activating bath 6 preceding phosphating. Sodium stearate is the sodium salt of stearic acid and a basic constituent of many soaps. Sodium stearate is a water-soluble solid. For example, about 0.01 g/l to 100 g/l of sodium stearate is added to the activating bath, with the activating bath 6 having an activating particle concentration in the range from 0.5 g/l to 3 g/l, preferably from 0.7 g/l to 1.5 g/l.

In a further working example of the method of the invention, poly(oxy-1,2-ethanediyl)carboxylic ester, in particular sorbityl poly(oxy-1,2-ethanediyl)monododecanoate, is added as additive A to the activating bath 6 which precedes phosphating. This additive, which is generally also referred to as polysorbate 20 (trade name "Tween® 20"), is a nonionic surfactant. It acts as wetting agent. For example, from 0.01 g/l to 100 g/l of polysorbate 20 ("Tween®20") are added per 1 l of activating bath having an activating particle concentration in the range from 0.1 g/l to 10 g/l, in particular from 0.5 g/l to 3.0 g/l, preferably from 0.7 g/l to 1.5 g/l. Instead of this additive, polysorbate 40, polysorbate 60, polysorbate 65 or polysorbate 80 (trade name "Tween® 80") can also be added as additive A to the activating bath 6.

In a further working example of the method of the invention, alkyl polyethylene glycol ether, in particular isotridecyl polyethylene glycol ether, is added to the activating bath 6. This additive is a nonionic surfactant whose state of matter is liquid. It acts, in particular, as wetting agent and is obtainable in a variety of variants under the trade name MARLIPAL®O13, with the different variants differing in the number of ethylene oxide molecules included. For example, from about 0.1 to 10 ml of alkyl polyethylene glycol ether are added as additive A per 1 l of activating bath 6 which has an activating particle concentration in the range from 0.1 g/l to 10 g/l, in particular from 0.5 g/l to 3.0 g/l, preferably from 0.7 g/l to 1.5 g/l.

In an advantageous optional embodiment of the above working examples of the method of the invention, the particle size distribution of the activating particles present in the activating bath 6 is determined and the activating bath 6 is replaced or taken out of operation as a function of the particle size distribution determined. The measurement of the particle size distribution is carried out by means of dynamic light scattering. As an alternative or in addition, the measurement of the particle size distribution can also be carried out by means of nanoparticle tracking analysis (NTA). The measurement of the particle size distribution of the activating particles of the activating bath 6 is preferably carried out on separate samples (part volumes) of the activating bath 6 or by means of at least one flow-through measurements cell (not shown), with both sampling and the measurement preferably being carried out at regular intervals or continuously during operation of the activating bath.

The replacement or taking out of operation of the activating bath 6 as a function of the particle size distribution of the activating particles determined in the activating bath 6 is then preferably likewise carried out automatically. The phosphating process can thus be conducted more reliably.

The invention claimed is:

1. A method for activating a metal surface prior to a phosphating process, the method comprising:

adding to an activating bath of activating particles dispersed in water an additive that suppresses or at least slows agglomeration of the activating particles, wherein the activating particles are based on at least one of phosphate or titanium;

adding to the activating bath a surfactant for suppressing or slowing agglomeration of the activating particles, wherein the surfactant is at least one of polyethylene glycol or sodium stearate; and bringing the metal surface into contact with the activating bath.

2. The method of claim 1 wherein the metal surface is a coated metal surface.

3. The method of claim 1 wherein the metal surface is a galvanized steel sheet.

4. The method of claim 1 further comprising agitating the activating bath continuously or discontinuously by at least one of stirring, pumped circulation, or ultrasound.

5. The method of claim 4 wherein the agitating occurs at least when the additive is added to the activating bath and when the metal surface is brought into contact with the activating bath.

6. The method of claim 5 further comprising stirring the activating bath by a mechanical stirrer.

7. The method of claim 1 further comprising:

determining a particle size distribution of the activating particles in the activating bath; and replacing the activating bath based on the particle size distribution of the activating particles.

8. The method of claim 7 wherein the determining of the particle size distribution of the activating particles occurs either continuously or periodically by way of dynamic light scattering during operation of the activating bath.

9. The method of claim 7 wherein the determining of the particle size distribution of the activating particles occurs either continuously or periodically by way of nanoparticle tracking analysis during operation of the activating bath.

10. The method of claim 1 further comprising adjusting the activating bath to have an activating particle concentration in a range of 0.1 g/l to 10 g/l.

11. The method of claim 1 further comprising adjusting the activating bath to have an activating particle concentration in a range of 0.5 g/l to 3 g/l.

12. The method of claim 1 further comprising adjusting the activating bath to have an activating particle concentration in a range of 0.7 g/l to 1.5 g/l.

13. A method for activating a metal surface for a phosphating process, the method comprising:

galvanizing the metal surface in an electrolytic cell;

adding to an activating bath of activating particles dispersed in water an additive that suppresses or at least slows agglomeration of the activating particles, wherein the activating particles are based on at least one of phosphate, titanium, or metal oxides;

determining a particle size distribution of the activating particles in the activating bath;

replacing the activating bath based on the particle size distribution of the activating particles; and bringing the metal surface into contact with the activating bath.

14. The method of claim 13 further comprising rinsing the metal surface after the metal surface is galvanized.

15. The method of claim 13 further comprising squeezing, wiping, or blowing the metal surface a liquid film from the metal surface after the metal surface exits the activating bath.

16. The method of claim 15 further comprising spraying a phosphating solution onto the metal surface after the metal surface exits the activating bath.

17. The method of claim 13 further comprising spraying a phosphating solution onto the metal surface after the metal surface exits the activating bath.

* * * * *